US008211847B1

(12) United States Patent
Ensinger et al.

(10) Patent No.: US 8,211,847 B1
(45) Date of Patent: Jul. 3, 2012

(54) HARD SURFACE CLEANER AND POLISH

(75) Inventors: April Ensinger, Huntley, IL (US); Thomas Keech, Roselle, IL (US); Katherine S. Maka, Inverness, IL (US); Daniel V. Beio, Huntley, IL (US)

(73) Assignee: R.I.T.A. Corporation, Crystal Lake, IL (US)

( * ) Notice: Subject to any disclaimer, the term of this patent is extended or adjusted under 35 U.S.C. 154(b) by 376 days.

(21) Appl. No.: 12/577,525

(22) Filed: Oct. 12, 2009

Related U.S. Application Data

(60) Provisional application No. 61/105,586, filed on Oct. 15, 2008.

(51) Int. Cl.
*C11D 7/60* (2006.01)

(52) U.S. Cl. ..... 510/241; 510/242; 510/268

(58) Field of Classification Search ..... 510/241, 510/242, 268; 106/11
See application file for complete search history.

(56) References Cited

U.S. PATENT DOCUMENTS

| | | | | |
|---|---|---|---|---|
| 6,746,977 | B2 * | 6/2004 | Schultz et al. | 442/164 |
| 7,374,592 | B2 * | 5/2008 | Hasinovic et al. | 51/304 |
| 2003/0129420 | A1 * | 7/2003 | Schultz et al. | 428/447 |
| 2007/0209549 | A1 * | 9/2007 | Hasinovic et al. | 106/11 |
| 2011/0150951 | A1 * | 6/2011 | Gonzales et al. | 424/401 |
| 2011/0262504 | A1 * | 10/2011 | Deleersnyder et al. | 424/401 |

* cited by examiner

*Primary Examiner* — Gregory Webb
(74) *Attorney, Agent, or Firm* — Marshall, Gerstein & Borun LLP

(57) ABSTRACT

A cleaner/polish composition for application to a hard surface, followed by wiping, to provide a clean, shiny surface is disclosed. The composition contains a functionalized dimethicone, nonionic surfactants, emulsifiers, a silicone fluid, an oxidized wax, an alkamidoalkyl dialkylamine, and water.

19 Claims, No Drawings

HARD SURFACE CLEANER AND POLISH

CROSS-REFERENCE TO RELATED APPLICATIONS

This application claims the benefit of U.S. provisional patent application No. 61/105,586, filed Oct. 15, 2008, incorporated herein by reference in its entirety.

FIELD OF THE INVENTION

The present invention relates to a cleaner and polish for hard surfaces, and especially for cars, trucks, motorcycles, boats, airplanes, farm vehicles, construction vehicles, and similar vehicles. More particularly, the present invention is directed to a composition for application to a hard surface, typically by spraying, followed by wiping the surface dry to provide a clean, shiny surface, while avoiding scratches, swirls, and streaks associated with present day hard surface cleaners.

BACKGROUND OF THE INVENTION

Present day hard surface cleaners typically utilize harsh anionic surfactants that can adversely affect the surface. Application of these cleaners requires at least a small amount of scrubbing or rubbing to effectively emulsify and remove dirt, oil, and grease. Such a mechanical removal of soils can further damage the surface, and may leave esthetically unacceptable streaks and swirls.

The anionic surfactant-based hard surface cleaners also can adversely affect the finish or shine of the cleaned surface. The cleaner therefore may contain a small amount of a wax or a silicone to impart a shine to the cleaned surface. Alternatively, a shine agent is applied to the surface after the cleaning step. In either case, the shine agent, either wax or silicone, is applied in low amounts and provides only a temporary shine effect. The shine agent typically does not contribute to the cleaning process.

The present invention is directed to overcoming problems associated with prior hard surface cleaners, and especially vehicle cleaners.

SUMMARY OF THE INVENTION

The present invention is directed to a hard surface cleaner and polish that effectively cleans and polishes without the need to rinse the composition from the surface. More particularly, the present invention is directed to a composition that is applied to a hard surface, typically by spraying, followed by wiping the surface dry. A present composition obviates the need to mechanically remove dirt, soil, and oil by rubbing or scrubbing, and obviates the need for a rinsing step.

Therefore, one aspect of the present invention is to provide a cleaner/polish composition comprising an aminofunctional dimethicone, a silicone fluid, a nonionic surfactant, an ethoxylated polyethylene wax, a stearate, an alkamidoalkyl dialkylamine, emulsifiers, and water.

A cleaner/polish of the present invention can be used "as is" or diluted with water. In accordance with the present invention, the polishing properties of the composition are enhanced at low and no dilutions, and the cleaning properties are enhanced at higher dilutions.

Another aspect of the present invention is to provide a cleaner/polish comprising an alkyl aminofunctional dimethicone, a dimethicone, a fatty acid dialkanolamide, an oxidized polyethylene wax, an alkamidoalkyl dialkylamine, one or more emulsifier (for example, an ethoxylated tridecyl alcohol, ethoxylated $C_{18}$-$C_{22}$ fatty alcohols, and mixtures thereof), and water. In the preparation of a present composition, the ingredients of the composition can be added individually or as preblends.

Yet another aspect of the present invention is to provide a cleaner/polish composition comprising water, a fatty acid dialkanolamide, a preservative, and the following tradename compositions, available from RITA Corporation, Crystal Lake, Ill., or equivalents thereof:

RITASIL SWM 9640 (alkyl aminofunctional dimethicone);

RITASIL SE 6730 (dimethicone, trideceth-6, trideceth-40);

RITASIL OWE 4660 (oleamidopropyl dimethylamine).

Another aspect of the present invention is to provide a method of cleaning and polishing a hard surface comprising spraying a composition of the present invention onto the surface, then wiping the composition from the surface. In some embodiments, the hard surface comprises a vehicle, such as a car, truck, boat, airplane, ATV, farm vehicle, construction vehicle, and the like.

These and other aspects of the present invention will become apparent from the following detailed description of the preferred embodiments.

DETAILED DESCRIPTION OF THE PREFERRED EMBODIMENTS

A cleaner/polish composition of the present invention comprises:

(a) about 1% to about 5%, by weight, of a fatty acid dialkanolamide;

(b) about 0.1% to about 3%, by weight, of an alkyl aminofunctional dimethicone;

(c) about 0.3% to about 10%, by weight, of a dimethicone;

(d) about 0.05% to about 0.5%, by weight, of an alkamidoalkyl dialkylamine;

(e) about 0.05% to about 0.5%, by weight, of an oxidized polyethylene wax; and (f) water.

The present compositions further comprise about 0.05% to about 4%, by weight, of one or more emulsifier, and 0% to about 0.5%, by weight, of a preservative.

More particularly, a cleaner/polish composition of the present invention comprises about 1% to about 5%, and preferably about 2% to about 4%, by weight, of a fatty acid dialkanolamide. To achieve the full advantage of the present invention the composition comprises about 2.5% to about 3.5%, by weight, of a fatty acid dialkanolamide.

The identity of the fatty acid dialkanolamide is not limited, and can be one or more of a $C_6$ to $C_{20}$ fatty acid dialkanolamide known in the art. Typically, the fatty acid dialkanolamide is a diethanolamide.

Nonlimiting examples of fatty acid dialkanolamides include, but are not limited to, capramide DEA, cocamide DEA, cocoyl sarcosinamide DEA, isostearamide DEA, lanolinamide DEA, lauramide DEA, lecithinamide DEA, linoleamide DEA, myristamide DEA, oleamide DEA, palmamide DEA, palmitamide DEA, palm kernelamide DEA, ricinoleamide DEA, soyamide DEA, stearamide DEA, tallamide DEA, tallowamide DEA, undecylenamide DEA, and mixtures thereof. A preferred fatty acid alkanolamide is cocamide DEA.

In addition to the fatty acid dialkanolamide, a present cleaner/polish composition comprises about 0.1% to about 3%, and preferably about 0.2% to about 2.5%, by weight, of an alkyl aminofunctional dimethicone. To achieve the full advantage of the present invention, the composition comprises about 0.25% to about 2%, by weight, of the alkyl aminofunctional dimethicone.

Typically, the alkyl group of the alkyl aminofunctional dimethicone, either linear or branched, contains 8 to 18 carbon atoms. One nonlimiting example of a useful alkyl aminofunctional dimethicone is amino-modified cetyl dimethicone.

A cleaner/polish composition of the present invention also comprises about 0.3% to about 10%, and preferably about 1% to about 8%, by weight, of a dimethicone. To achieve full advantage of the present invention, the composition comprises about 2% to about 6%, by weight, of a dimethicone.

The identity of the dimethicone is not particularly limited, but typically is a polydimethylsiloxane fluid having a viscosity of about 100 to about 5,000 centistokes at 25° C. The dimethicone can be a single dimethicone or a blend of dimethicones. Preferred dimethicones have a viscosity of about 200 to about 1,000 centistokes at 25° C.

A cleaner/polish of the present invention also comprises about 0.02% to about 0.5%, and preferably about 0.03% to about 0.4%, by weight, of an alkamidoalkyl dialkylamine. To achieve the full advantage of the present invention, the composition comprises about 0.05% to about 0.35%, by weight, of an alkamidoalkyl dialkylamine.

The alkamidoalkyl dialkylamine typically is a $C_{10}$-$C_{24}$ alkamido$C_{2-3}$alkyl di$C_{1-2}$alkylamine. Nonlimiting examples of the alkamidoalkyl dialkylamine include, but are not limited to, stearamidoethyl diethylamine, behenamidopropyl dimethylamine, lauramidopropyl dimethylamine, palmitamidopropyl dimethylamine, isostearamidopropyl dimethylamine, myristamidopropyl dimethylamine, oleamidopropyl dimethylamine, stearamidopropyl dimethylamine, and mixtures thereof.

A present cleaner/polish composition also comprises about 0.02% to about 0.5%, and preferably about 0.03% to about 0.4%, by weight, of an oxidized polyethylene wax.

The carrier of the cleaner/polish is water, which is present in an amount of about 80% to about 95% of the composition. The composition also can contain a low amount of a water-soluble organic solvent, such as an alcohol, diol, or ketone, to assist in solubilizing or dispersing the ingredients of the composition, or to adjust the viscosity of the composition. A water-soluble organic solvent is present in an amount of 0% to about 5%, by weight, of the composition.

In addition to the ingredients disclosed above, a present cleaner/polish also comprises one or more emulsifiers. The identity and amount of the emulsifier is not limited, as long as the emulsifier provides a stable emulsion. Typically, the emulsifier is present in an amount of about 0.1% to about 4%, by weight, of the composition.

Preferred emulsifiers are nonionic and include, but are not limited to, ethoxylated $C_{10}$-$C_{22}$ fatty alcohols, $C_{10}$-$C_{22}$ fatty alcohol ethers (such as trideceth-6, trideceth-7, trideceth-9, trideceth-10, trideceth-11, trideceth-12, trideceth-15, trideceth-20, trideceth-30, trideceth-40, trideceth-50, and mixtures thereof), ethoxylated oleic alcohol, an ethoxylated branched $C_{10}$ alcohol, a stearic acid ester, and mixtures thereof. Additional $C_{10}$-$C_{22}$ fatty alcohol ethers include, but are not limited to, ceteareth-2 through ceteareth-55, ceteth-1 through ceteth-25, isoceteth-10 through isoceteth-30, isodeceth-4 through isodeceth-6, laneth-5 through laneth-75, laureth-1 through laureth-40, steareth-2 through steareth-100, and any mixture thereof.

A present composition also can contain optional ingredients known in the art of cleaner/polish compositions. The optional ingredients are present individually in a sufficient amount to perform their intended function, and collectively in an amount that does not adversely affect the composition. Typically, each optional ingredient is present in an amount of about 0.01% to about 1%, by weight, of the composition. The optional ingredients typically are present in a total amount of about 0.1% to about 3%, by weight, of the composition.

One optional ingredient is a preservative, such as phenoxyethanol, in an amount of about 0.1% to about 1%, by weight, of the composition. Other nonlimiting optional ingredients include, but are not limited to, dyes, fragrances, chelating agents, hydrotropes, opacifiers, and similar compounds.

A composition of the present invention is prepared by simply admixing the composition ingredients. In some embodiments, preblends are utilized in the preparation of the compositions.

In one embodiment, a present composition is prepared by blending the following ingredients in any order:

| Ingredients | % W/W |
|---|---|
| Distilled Water | 80-90 |
| Cocamide DEA | 2-4 |
| Phenoxyethanol | 0.3-0.8 |
| RITASIL SWM 9640[1)] | 0.5-2 |
| RITALSIL SE 6730[2)] | 5-20 |
| RITASIL OWE 4660[3)] | 1-4 |

[1)]amino-modified cetyldimethicone, trideceth-40, branched $C_{10}$ alcohol with 7 moles ethylene oxide, and water;
[2)]dimethicone, trideceth-6, trideceth-40, and water; and
[3)]oleamidopropyl dimethylamine, ethoxylated oleic alcohol, ethoxylated $C_{20}$-$C_{22}$ fatty alcohols, oxidized polyethylene wax, stearic acid ester, and water A cleaner/polish composition of the present invention is applied to a hard surface, typically by spraying. It is not necessary to dilute the composition prior to application to the hard surface. Typically, a present cleaner/polish composition is used "as is" or is diluted with up to 8 parts water, by volume, for each volume part of the composition. At no or a low dilution, the polishing properties of the composition are enhanced; at a higher dilution, the cleaning properties of the composition are enhanced.

Simple application of the composition provides the cleaning action. No mechanical scrubbing or rubbing is necessary to remove dirt, grease, and oil from the surface. In addition, it is not necessary to rinse the cleaner/polish from the surface. The composition is simply wiped from the surface and the surface is allowed to dry. The resulting surface is clean, shiny, and exhibits no streaks, scratches, or swirls.

It is theorized, but not relied upon, that the silicone components of the composition coat the soil particles, which result in an easy soil removal with no surface scratching. In addition, the finish is smooth and shiny as a freshly polished surface. A present composition also effectively removes brake dust from wheels, and retards the accumulation of brake dust on the wheels.

A present cleaner/polish composition is designed for all hard surfaces, and particularly for impervious surfaces, such as metal, plastic, a mineral surface (like marble or similar stone), and glass. The compositions are especially useful in the cleaning and polishing of vehicles, including cars, trucks, busses, motorcycles, trains, boats, ATVs, and similar vehicles.

The invention claimed is:

1. A composition comprising:

(a) about 1% to about 5%, by weight, of a fatty acid dialkanolamide;

(b) about 0.1% to about 3%, by weight, of an alkyl amino-functional dimethicone;

(c) about 0.3% to about 10%, by weight, of a dimethicone;

(d) about 0.05% to about 0.5%, by weight, of an alkamidoalkyl dialkylamine;

(e) about 0.05% to about 0.5%, by weight, of an oxidized polyethylene wax; and (f) water.

2. The composition of claim 1 wherein the fatty acid alkanolamide comprises a $C_6$ to $C_{20}$ fatty acid dialkanolamide.

3. The composition of claim 1 wherein the fatty acid dialkanolamide is selected from the group consisting of capramide DEA, cocamide DEA, cocoyl sarcosinamide DEA, isostearamide DEA, lanolinamide DEA, lauramide DEA, lecithinamide DEA, linoleamide DEA, myristamide DEA, oleamide DEA, palmamide DEA, palmitamide DEA, palm kernelamide DEA, ricinoleamide DEA, soyamide DEA, stearamide DEA, tallamide DEA, tallowamide DEA, undecylenamide DEA, and mixtures thereof.

4. The composition of claim 1 wherein the fatty acid dialkanolamide comprises cocamide DEA.

5. The composition of claim 1 wherein the alkyl amino-functional dimethicone comprises an amino-modified cetyl dimethicone.

6. The composition of claim 1 wherein the dimethicone has a viscosity of about 100 to about 5000 centistokes at 25° C.

7. The composition of claim 1 wherein the alkamidoalkyl dialkylamine comprises a $C_{10-24}$ alkamido$C_{2-3}$alkyl di$C_{1-2}$alkylamine.

8. The composition of claim 1 wherein the alkamidoalkyl dialkylamine is selected from the group consisting of stearamidoethyl diethylamine, behenamidopropyl dimethylamine, lauramidopropyl dimethylamine, palmitamidopropyl dimethylamine, isostearamidopropyl dimethylamine, myristamidopropyl dimethylamine, oleamidopropyl dimethylamine, stearamidopropyl dimethylamine, and mixtures thereof.

9. The composition of claim 1 wherein the alkamidoalkyl dialkylamine comprises oleamidopropyl dimethylamine.

10. The composition of claim 1 further comprising about 0.05% to about 4%, by weight of an emulsifier.

11. The composition of claim 10 wherein the emulsifier comprises an ethoxylated $C_{10}$-$C_{22}$ fatty alcohol, a $C_{10}$-$C_{22}$ fatty alcohol ether, ethoxylated oleic alcohol, an ethoxylated branched $C_{10}$ alcohol, a stearic acid ester, or mixtures thereof.

12. The composition of claim 10 wherein the $C_{10}$-$C_{22}$ fatty alcohol comprises trideceth-6, trideceth-7, trideceth-9, trideceth-10, trideceth-11, trideceth-12, trideceth-15, trideceth 20, trideceth-30, trideceth-40, trideceth-50, or mixtures thereof.

13. The composition of claim 1 further comprising a preservative.

14. The composition of claim 13 wherein the preservative comprises phenoxyethanol.

15. A method of cleaning and polishing a hard surface comprising applying a composition of claim 1 to the surface, then wiping the composition from the surface.

16. The method of claim 15 wherein one volume part of the composition of claim 1 is diluted with up to eight volume parts of water prior to applying the composition to the surface.

17. The method of claim 15 wherein the method is free of a rinsing step.

18. The method of claim 15 wherein the hard surface is a metal, a plastic, a mineral surface, or a glass.

19. The method of claim 15 wherein the hard surface is present on a car, truck, bus, motorcycle, ATV, boat, airplane, farm vehicle, construction vehicle, or train.

* * * * *